US011851138B1

(12) United States Patent
Lambert

(10) Patent No.: US 11,851,138 B1
(45) Date of Patent: Dec. 26, 2023

(54) REAR FLIP SEAT WITH TABLE

(71) Applicant: Protomet Corporation, Oak Ridge, TN (US)

(72) Inventor: Dale Lee Lambert, Oak Ridge, TN (US)

(73) Assignee: Protomet Corporation, Oak Ridge, TN (US)

( * ) Notice: Subject to any disclaimer, the term of this patent is extended or adjusted under 35 U.S.C. 154(b) by 0 days.

(21) Appl. No.: 18/336,142

(22) Filed: Jun. 16, 2023

Related U.S. Application Data

(60) Provisional application No. 63/367,479, filed on Jun. 30, 2022.

(51) Int. Cl.
*B63B 29/04* (2006.01)
*A47C 7/40* (2006.01)
*A47B 83/02* (2006.01)

(52) U.S. Cl.
CPC ..... *B63B 29/04* (2013.01); *A47B 83/0213* (2017.08); *A47C 7/407* (2013.01); *B63B 2029/043* (2013.01); *B63B 2029/046* (2013.01)

(58) Field of Classification Search
CPC ..... B63B 29/04; A47C 7/407; A47B 83/0213; B60N 2/06
See application file for complete search history.

(56) References Cited

U.S. PATENT DOCUMENTS

| | | | | | |
|---|---|---|---|---|---|
| 3,428,976 | A * | 2/1969 | Robinson | B63B 29/04 | 114/361 |
| 4,722,706 | A * | 2/1988 | Young | B63B 29/04 | 440/7 |
| 5,088,135 | A * | 2/1992 | Violette | B60P 3/36 | 5/8 |
| 5,098,154 | A | 3/1992 | Emery | | |
| 5,136,963 | A * | 8/1992 | Zuzik | B63B 29/10 | 114/343 |
| 7,513,211 | B1 | 4/2009 | Farb et al. | | |
| 7,661,382 | B2 | 2/2010 | Wood et al. | | |
| 8,517,466 | B1 | 8/2013 | Wizorek et al. | | |
| 9,073,608 | B1 | 7/2015 | Foss et al. | | |
| 9,783,271 | B2 * | 10/2017 | Foss | B63B 29/04 | |
| 9,821,887 | B1 * | 11/2017 | Wilson | B63B 29/04 | |
| D819,540 | S | 6/2018 | Wilson et al. | | |
| 10,065,711 | B2 | 9/2018 | Fuller et al. | | |
| 10,149,544 | B2 * | 12/2018 | Fafard | B63B 29/04 | |
| 10,933,774 | B2 * | 3/2021 | Curts | B63B 29/04 | |
| 11,267,538 | B2 * | 3/2022 | Ekern | B63B 29/04 | |

(Continued)

*Primary Examiner* — S. Joseph Morano
*Assistant Examiner* — Jovon E Hayes
(74) *Attorney, Agent, or Firm* — Robinson IP Law, PLLC

(57) ABSTRACT

Various implementations include a seat assembly having one or more track brackets, one or more slide brackets, and a seat bottom. A track face of each of the track brackets defines one or more tracks. A first end of each of the tracks is closer than a second end of the respective track to a fore edge and a bottom edge of the track bracket. The slide brackets include one or more pins slidably engaging one of the tracks. The slide brackets are slidable between a first slide position and a second slide position. At least one of the pins is located adjacent the first end of the track in the first slide position and one of the pins is located adjacent the second end of the track in the second slide position. The seat bottom is coupled to the slide brackets.

19 Claims, 10 Drawing Sheets

(56) References Cited

U.S. PATENT DOCUMENTS

| | | | | |
|---|---|---|---|---|
| 11,286,022 | B1 * | 3/2022 | Freer | B63B 29/04 |
| 11,419,427 | B2 * | 8/2022 | Niemela | F16B 12/28 |
| 2009/0277372 | A1 * | 11/2009 | Wood | B63B 29/04 297/94 |
| 2010/0037814 | A1 | 2/2010 | Sahr et al. | |
| 2010/0319604 | A1 * | 12/2010 | Mayrand | B63B 29/04 114/363 |
| 2011/0168077 | A1 * | 7/2011 | Bostrom | B63B 29/06 297/344.13 |
| 2017/0225751 | A1 * | 8/2017 | Fuller, IV | B63B 29/04 |
| 2018/0229816 | A1 | 8/2018 | Fafard et al. | |
| 2018/0229817 | A1 * | 8/2018 | Fafard | B63B 29/04 |
| 2022/0185168 | A1 * | 6/2022 | Niemela | A47C 17/48 |

* cited by examiner

REAR FLIP SEAT WITH TABLE

FIELD

This disclosure relates to vehicle seating. More particularly, this disclosure relates to a seat that is convertible into multiple positions on a vehicle, such as a boat.

BACKGROUND

Vehicles such as watercraft may feature a variety of seating arrangements for passengers riding in the vehicle. For example, a watercraft such as a wake or tow boat may include a bow seating area and an area aft of a windshield of the watercraft. When in use, it may be desirable for some of the seating to be rear facing within the watercraft to allow spectating of water sports behind the watercraft. However, providing a seat that is rear facing with respect to the watercraft may require a significant amount of space on the watercraft.

Further, when carrying passengers, it may be desirable to include areas for placing objects, such as a table. However, placing a table on a vehicle such as a watercraft similarly often requires space that may otherwise be utilized for seating passengers on the vehicle or otherwise reduce an amount of deck space available on the vehicle. Further, although existing attempts have been made to provide stowable tables, such attempts further utilize space that may be otherwise used for passenger seating or other valuable space on the vehicle.

SUMMARY

In some aspects, the present disclosure relates to a seat assembly including: one or more track assemblies, the one or more track assemblies including at least one slot formed therein; one or more slide brackets movably supported on the one or more track assemblies with one or more pins; a seat bottom horizontally mounted on the one or more slide brackets; a backrest bracket pivotally mounted on the one or more slide brackets; and a backrest portion rotatably mounted on the backrest bracket, the backrest portion having a first side forming a backrest surface and a second side forming a table surface; wherein the seat assembly is positionable in a plurality of configurations; wherein in one of the plurality of configurations the backrest portion is upright relative to the seat bottom; wherein in one of the plurality of configurations the backrest portion is horizontal relative to the seat bottom with the second side forming a table surface facing upward; and wherein in one of the plurality of configurations the backrest portion is horizontal relative to the seat bottom with the first side forming a backrest surface facing upward.

Various implementations include a seat assembly. The seat assembly includes one or more track brackets, one or more slide brackets, and a seat bottom. The one or more track brackets each have a track face, a fore edge, an aft edge opposite and spaced apart from the aft edge, a first edge extending between the fore edge and the aft edge, and a second edge opposite and spaced apart from the first edge. The track face of each of the one or more track brackets defines one or more tracks. The one or more tracks each have a first end and a second end longitudinally spaced apart from the first end. The first end of each of the one or more tracks is closer than the second end of the respective track to the fore edge and the second edge. The one or more slide brackets include one or more pins extending therefrom.

Each of the one or more pins slidably engages one of the one or more tracks. The one or more slide brackets are slidable between a first slide position and a second slide position. At least one of the one or more pins is located adjacent the first end of the track to which it is engaged in the first slide position and the one of the one or more pins or another of the one or more pins is located adjacent the second end of the track to which it is engaged in the second slide position. The seat bottom is coupled to the one or more slide brackets.

In some implementations, the one or more track brackets include two track brackets and the one or more slide brackets include two slide brackets.

In some implementations, the one or more tracks include two tracks defined by each of the one or more track brackets. In some implementations, the one or more pins include two pins extending from each of the one or more slide brackets. In some implementations, each of the two pins extending from each of the one or more slide brackets engages a separate one of the two tracks.

In some implementations, the seat assembly further includes one or more backrest brackets and a backrest portion. In some implementations, the one or more backrest brackets are each coupled to a separate one of the one or more slide brackets. In some implementations, the backrest portion is coupled to the one or more backrest brackets.

In some implementations, the one or more backrest brackets are each pivotally coupled to the separate one of the one or more slide brackets. In some implementations, the one or more backrest brackets are pivotable relative to the one or more slide brackets between a first bracket position and a second bracket position. In some implementations, the backrest portion is closer to the seat bottom in the first bracket position than it is in the second bracket position.

In some implementations, the seat assembly further includes a backrest bracket release mechanism for releasably retaining the backrest bracket in the first bracket position or the second bracket position.

In some implementations, the backrest portion is pivotably coupled to the one or more backrest brackets. In some implementations, the backrest portion has a first side and a second side opposite and spaced apart from the first side. In some implementations, the first side includes a cushion. In some implementations, the second side includes a tabletop. In some implementations, the tabletop of the second side of the backrest portion defines one or more recesses.

In some implementations, the seat bottom has a seat surface. In some implementations, the backrest portion is pivotable relative to the one or more backrest brackets between a first backrest position and a second backrest position. In some implementations, the first side of the backrest portion forms a backrest for the seat bottom in the first backrest position and the second side of the backrest portion is substantially parallel with the seat surface in the second backrest position.

In some implementations, the seat assembly further includes a backrest release mechanism for releasably retaining the backrest portion in the first backrest position or the second backrest position.

Various other implementations include a seat assembly. The seat assembly includes one or more track brackets, one or more slide brackets, one or more backrest brackets, a seat bottom, and a backrest portion. The one or more track brackets each have a track face. The track face of each of the one or more track brackets defines one or more tracks. The one or more slide brackets include one or more pins extending therefrom. Each of the one or more pins slidably engages one of the one or more tracks. The one or more backrest brackets are each pivotally coupled to a separate one of the one or more slide brackets. The seat bottom is coupled to the one or more slide brackets. The backrest portion is coupled to the one or more backrest brackets. The one or more backrest brackets are pivotable relative to the one or more slide brackets between a first bracket position and a second bracket position. The backrest portion is closer to the seat bottom in the first bracket position than it is in the second bracket position.

In some implementations, the seat assembly further includes a backrest bracket release mechanism for releasably retaining the backrest bracket in the first bracket position or the second bracket position.

In some implementations, the backrest portion is pivotably coupled to the one or more backrest brackets. In some implementations, the backrest portion has a first side and a second side opposite and spaced apart from the first side. In some implementations, the first side includes a cushion. In some implementations, the second side includes a tabletop. In some implementations, the tabletop of the second side of the backrest portion defines one or more recesses.

In some implementations, the seat bottom has a seat surface. In some implementations, the backrest portion is pivotable relative to the one or more backrest brackets between a first backrest position and a second backrest position. In some implementations, the first side of the backrest portion forms a backrest for the seat bottom in the first backrest position and the second side of the backrest portion is substantially parallel with the seat surface in the second backrest position.

In some implementations, the seat assembly further includes a backrest release mechanism for releasably retaining the backrest portion in the first backrest position or the second backrest position.

Various other implementations include a seat assembly. The seat assembly includes one or more track brackets, one or more slide brackets, one or more backrest brackets, a seat bottom, and a backrest portion. The one or more track brackets each have a track face. The track face of each of the one or more track brackets defines one or more tracks. The one or more slide brackets include one or more pins extending therefrom. Each of the one or more pins slidably engages one of the one or more tracks. The one or more backrest brackets are each coupled to a separate one of the one or more slide brackets. The seat bottom is coupled to the one or more slide brackets. The seat bottom has a seat surface. The backrest portion is pivotably coupled to the one or more backrest brackets. The backrest portion has a first side and a second side opposite and spaced apart from the first side. The first side includes a cushion. The second side includes a tabletop. The backrest portion is pivotable relative to the one or more backrest brackets between a first backrest position and a second backrest position. The first side of the backrest portion forms a backrest for the seat bottom in the first backrest position and the second side of the backrest portion is substantially parallel with the seat surface in the second backrest position.

In some implementations, the tabletop of the second side of the backrest portion defines one or more recesses.

In some implementations, the seat assembly further includes a backrest release mechanism for releasably retaining the backrest portion in the first backrest position or the second backrest position.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
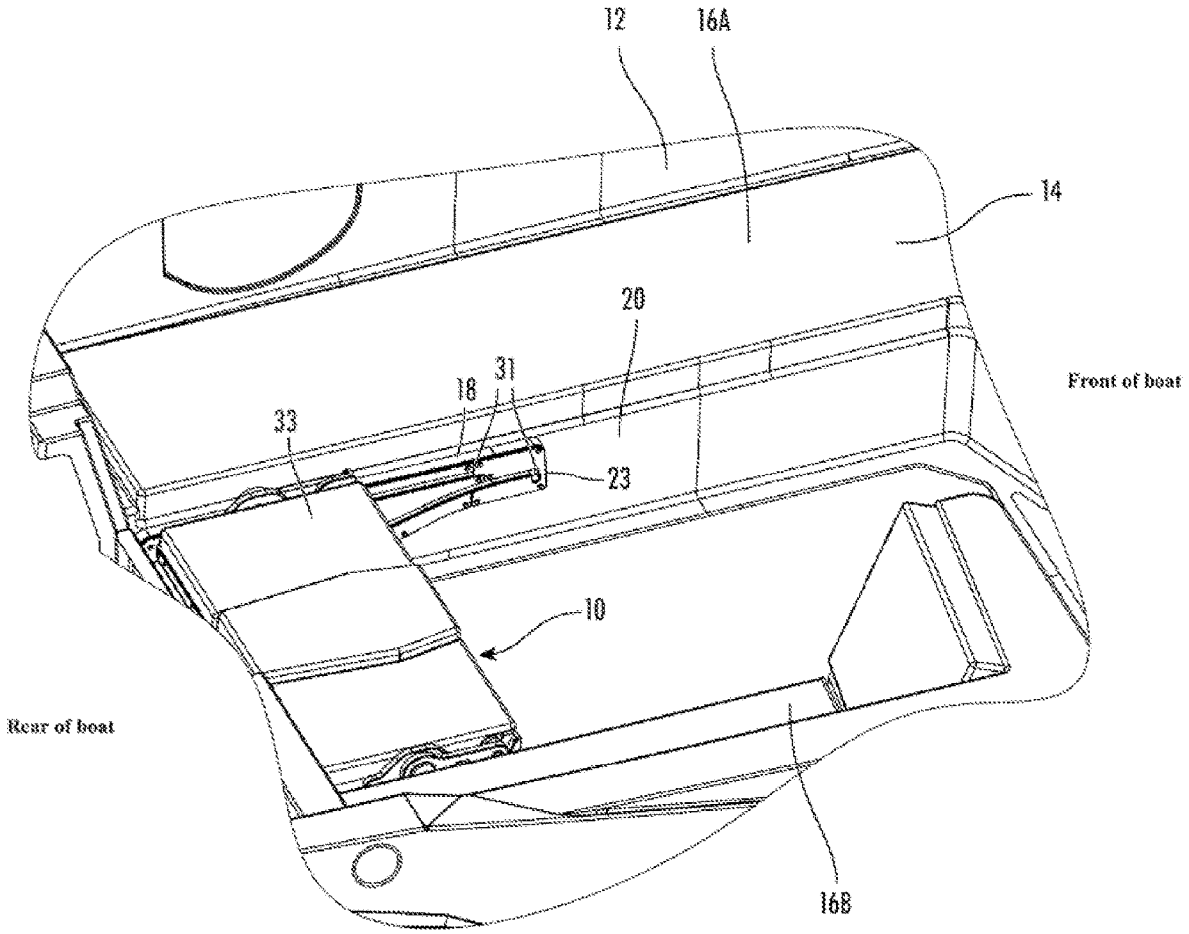
FIG. 1 shows a seat assembly on a watercraft according to one embodiment of the present disclosure.

FIG. 1 shows a seat assembly 10 that is capable of being arranged in a plurality of configurations. The seat assembly 10 may be arranged such that the seat assembly 10 may support one or more passengers seated on or proximate to the seat assembly 10. The seat assembly 10 may further be configured such that a portion of the seat assembly 10 may serve as a table or other flat surface for resting items thereon. The seat assembly 10 may be mounted on a vehicle. In some implementations, the seat assembly 10 may be mounted on a watercraft 12. In some implementations, the seat assembly 10 may be mounted on a boat. The seat assembly 10 is configured to be positionable in a plurality of configurations that allow the seat assembly 10 to provide seating for passengers on the watercraft 12 and/or to provide a surface that may act as a table for use by passengers on the watercraft 12.

The seat assembly 10 may be located towards an aft or rear portion of the watercraft 12, such as at a seating area 14 of the watercraft 12. The seat assembly 10 may be oriented on the watercraft 12 such that when the seat assembly 10 is configured to provide seating for passengers on the watercraft 12, the seat assembly 10 may support passengers such that the passengers are facing a bow or front of the watercraft 12, which may depend on a configuration of the seat assembly 10 as described in greater detail below. The seat assembly 10 may be located at the seating area 14 such that the seat assembly 10 is between a first bench seat 16A located towards a port side of the watercraft 12 and a second bench seat 16B located towards a starboard side of the watercraft 12.

The seat assembly 10 is mounted on at least one track bracket 18. Reference herein is made to the at least one track bracket 18. Although not shown in the drawings for the purpose of clarity, it is understood that the seat assembly 10 may be supported on two or more of the at least one track bracket 18. For example, a pair of the at least one track bracket 18 may be mounted on the watercraft 12 such that the seat assembly is mounted on the pair of the at least one track bracket 18. A first of the at least one track bracket 18 may be mounted towards a port side of the watercraft 12, and a second of the at least one track bracket 18 may be mounted towards a starboard side of the watercraft 12. The at least one track bracket 18 may be mounted to a substantially vertical surface 20 of the watercraft 12 relative to a gravitational axis, such as underneath the first bench seat 16A and the second bench seat 16B. The at least one track bracket 18 may be mounted on the watercraft 12 with one or more of fasteners, adhesives, or other means of securing the at least one track bracket 18 for supporting portions of the seat assembly 10 as described herein.

Figure 2:
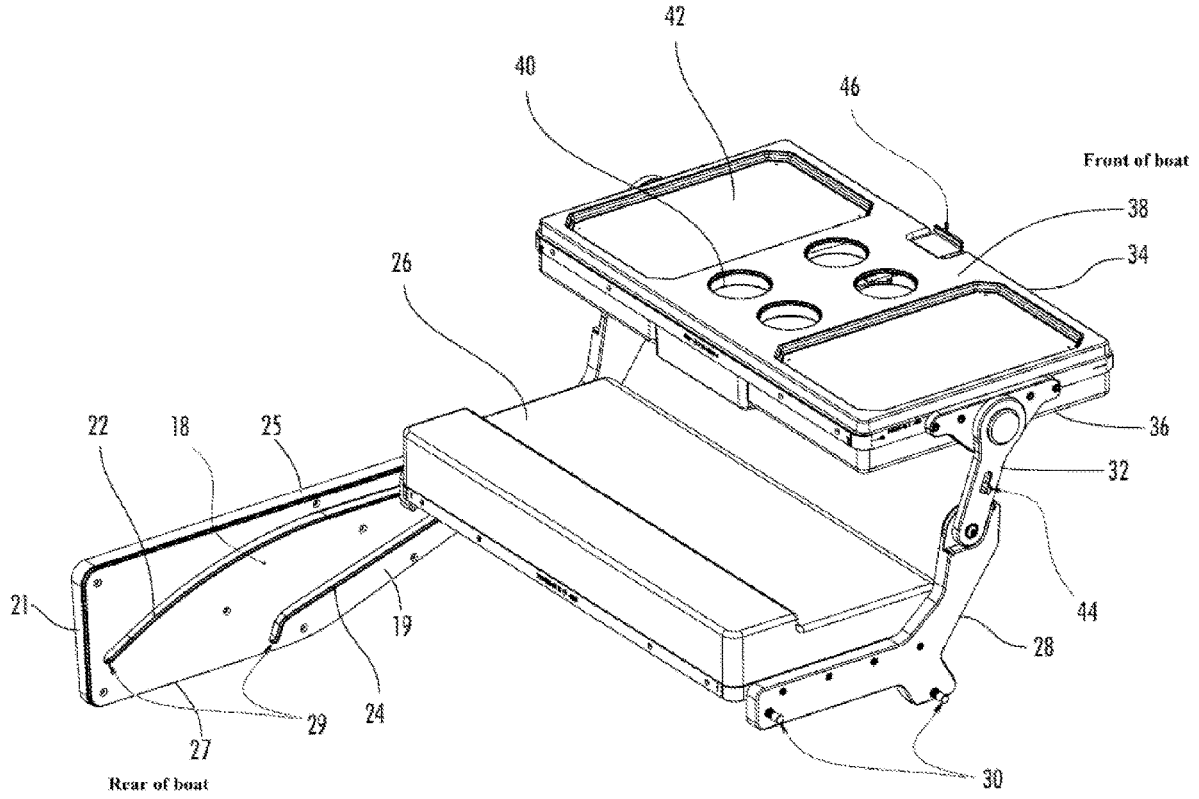
FIG. 2 shows a seat assembly in a configuration as a table according to one embodiment of the present disclosure.

Referring now to FIG. 2, the at least one track bracket 18 includes a track face 19, a fore edge 21, an aft edge opposite 23 and spaced apart from the fore edge 21, a first edge 25 extending between the fore edge 21 and the aft edge 23, and a second edge 27 opposite and spaced apart from the first edge 25 such that the second edge 27 is below the first edge 25 relative to a gravitational axis in the watercraft's 12 normal configuration. The track face 19 of the at least one track bracket 18 may define one or more tracks that are oriented to allow the seat assembly 10 to move between various configurations on the watercraft 12. The at least one track bracket 18 may include a first track 22 and a second track 24. The first track 22 and the second track 24 may extend along a substantial length of the at least one track bracket 18. The first track 22 may be located above the second track 24 as shown in FIG. 2. The first track 22 and the second track 24 may each include a first end 29 and a second end 31 longitudinally spaced apart from the first end 29. The at least one track 22, 24 may be inclined along at least a portion of the first track 22 and the second track 24 from the first end 29 of the at least one track bracket 18 towards the second end 31 of the at least one track bracket 18 such that the first end 29 of each of the one or more tracks 22, 24 is closer than the second end 31 of the respective track 22, 24 to the fore edge 21 and the second edge 27.

The seat assembly 10 further includes a seat bottom 26 mounted on at least one slide bracket 28. The seat bottom 26 may include a cushioned surface located on a seat surface 33 of the seat bottom 26 such that the seat bottom 26 may act as a seat for passengers of the watercraft 12 when the seat assembly 10 is in at least one configuration as described herein. The seat bottom 26 may include a raised portion located thereon for supporting a table in a level position on the seat bottom 26 as described herein.

The at least one slide bracket 28 includes a plurality of slide track pins 30 extending from the slide bracket 28. The plurality of slide track pins 30 are shaped to slidably engage the first track 22 and the second track 24 of the at least one track bracket 18. The plurality of slide track pins 30 may be at least partially offset from one another such that the plurality of slide track pins 30 that engage the first track 22 are closer to the fore edge 21 and the first edge 25 than the plurality of slide track pins 30 that engage the second track 24 are to the fore edge 21 and the first edge 25 of the at least one track bracket 18.

The at least one slide bracket 18 is slidable along the one or more tracks 22, 24 of the at least one track bracket 18 between a first slide position and a second slide position. At least one of the pins 30 of the at least one slide bracket 28 is located adjacent the first end 29 of the track 22, 24 to which it is engaged in the first slide position, and the at least one of the pins 30 or another of the pins 30 is located adjacent the second end 31 of the track 22, 24 to which it is engaged in the second slide position.

A backrest bracket 32 is mounted to each of the slide brackets 18 and supports a backrest portion 34 on the seat assembly 10. The backrest bracket 32 may be pivotally mounted to the slide bracket 18 such that the backrest portion 34 is movable between a first bracket position and a second bracket position. The backrest portion 34 is closer to the seat bottom 26 in the first bracket position than it is in the second bracket position.

The backrest portion 34 is pivotally mounted on the backrest bracket 32 such that the backrest portion 34 may rotate relative to the backrest bracket 32 between a first backrest position, a second backrest position, and a third backrest position. The backrest portion 34 may include a first side 36 and a second side 38 opposite and spaced apart from the first side 36. The first side 36 of the backrest portion 34 may include a cushion such that the first side 36 may be configured as a backrest for a passenger on the watercraft 12 seated against the backrest portion 34 in the first backrest position. The second side 38 of the backrest portion 34 may be substantially solid and form a tabletop such that the second side 38 may be configured facing away from the seat surface 33 and substantially parallel to the seat surface 33 of the seat bottom 26 and usable as a table surface on the watercraft 12 in the second backrest position. The first side 36 of the backrest portion 34 is facing away from the seat surface 33 and substantially parallel to the seat surface 33 of the seat bottom 26 in the third backrest position. The second side 38 may include one or more recessed cupholders formed thereon 40 and one or more recessed tray portions 42 for receiving items on the second side 38 of the backrest portion 34. However, in some implementations, the second side can include two or more tabletops and can include any other closed shape that is either raised or recessed from the second side.

Figure 3A:
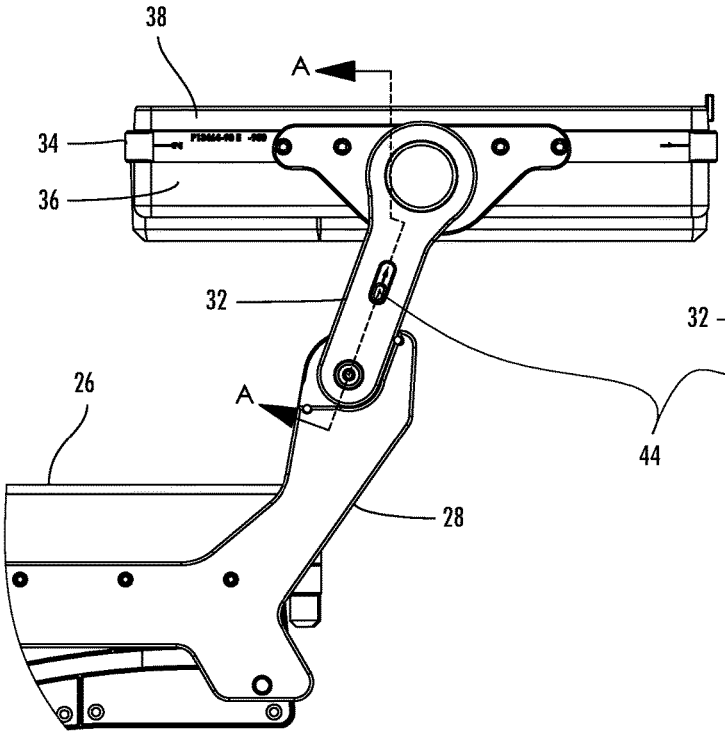
FIG. 3A and FIG. 3B show a side view of a seat assembly according to one embodiment of the present disclosure.
Figure 3B:
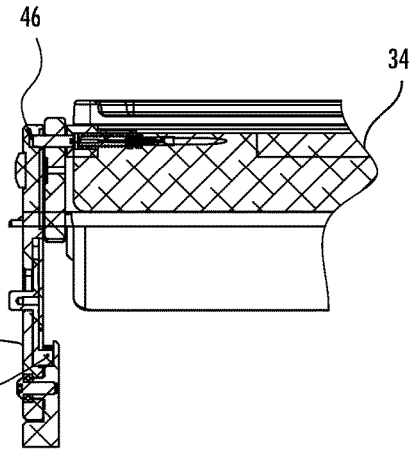

A backrest bracket release mechanism 44 is configured to releasably retain the backrest bracket 32 in the first bracket position and/or the second bracket position. As shown in FIG. 3A and FIG. 3B, the backrest bracket release mechanism 44 may be located along a side of the backrest bracket 32 or slide bracket 28 and may be slidable relative to the backrest bracket 32 or slide bracket 28, respectively, to release the backrest bracket 32 and allow the backrest bracket 32 to pivot relative to the slide bracket 28. The backrest portion 34 may further include a backrest release mechanism 46. The backrest release mechanism 46 is configured to releasably retain the backrest portion 34 in in the first backrest position, the second backrest position, and/or the third backrest position.

Figure 4A:
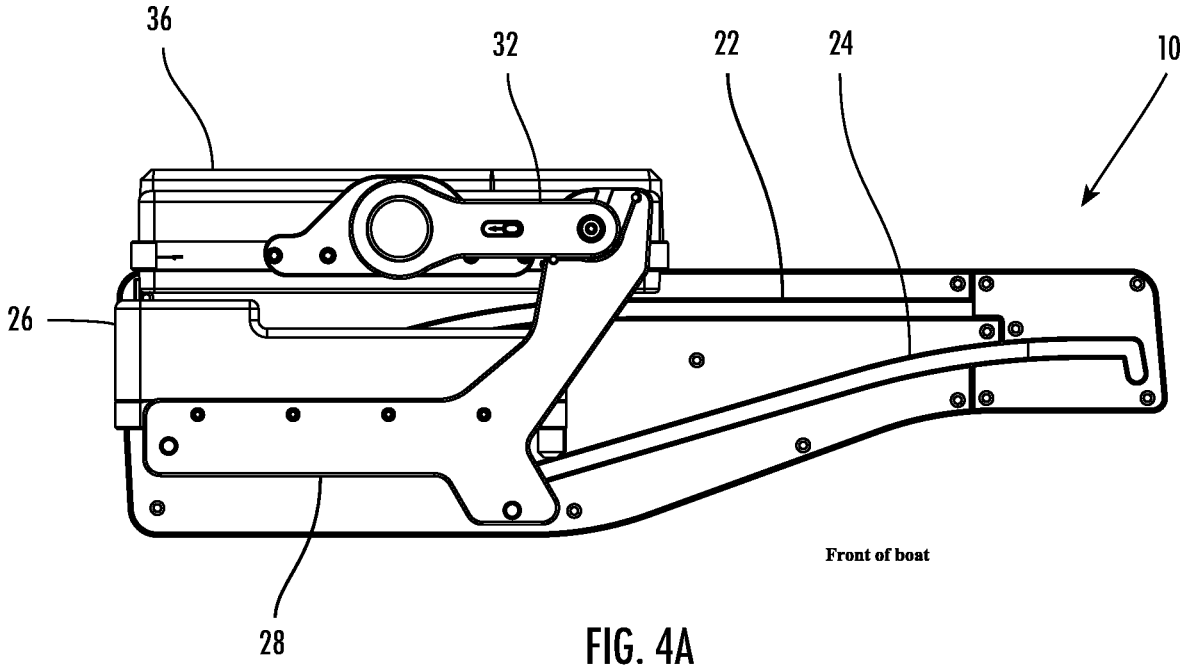
FIG. 4A and FIG. 4B show a seat assembly in one configuration as a seat according to one embodiment of the present disclosure.
Figure 4B:
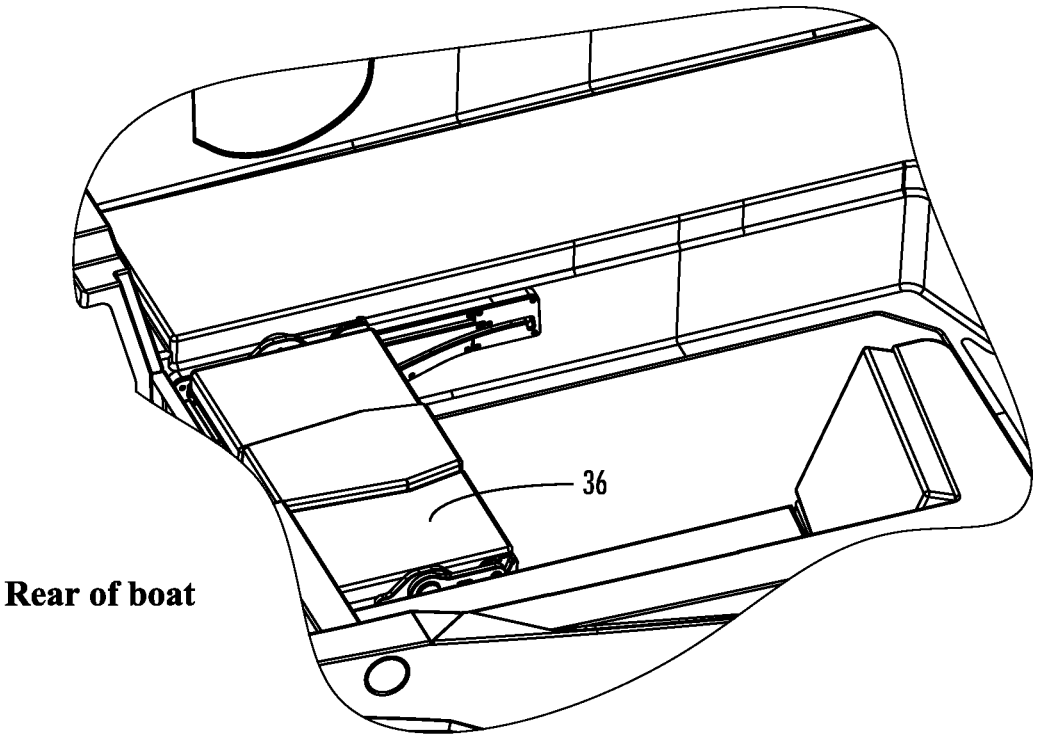

The seat assembly 10 is movable between a plurality of configurations that allow the backrest assembly 10 to act as a seat for passengers on the watercraft 12 and/or to provide a table for passengers on the watercraft 12. FIG. 4A and FIG. 4B show the seat assembly 10 in one configuration in which the slide brackets 28 are in the first slide position, the backrest brackets 32 are in the first bracket position, and the backrest 34 is in the third backrest position. The backrest portion 34 is rotated relative to the backrest bracket 32 such that the first side 36 of the backrest portion 34 is facing upward relative to a gravitational axis. The backrest bracket 32 is pivoted relative to the slide bracket 28 such that the second side 38 of the backrest portion 34 abuts or is adjacent to the seat bottom 26. The slide bracket 28 may be located towards a rear or aft portion of the watercraft 12 on the track bracket 18. In the configuration of FIG. 4A and FIG. 4B, the first side 36 of the backrest portion 34 may act as a seat or bench for a passenger on the watercraft 12.

Figure 5A:
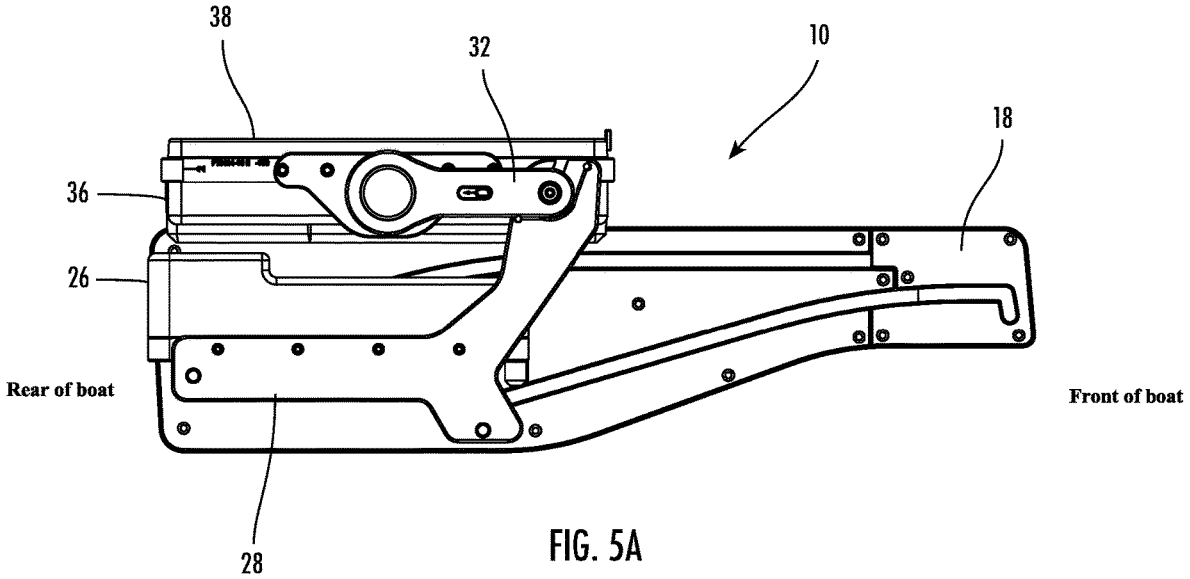
FIG. 5A and FIG. 5B show a seat assembly in one configuration as a table according to one embodiment of the present disclosure.
Figure 5B:
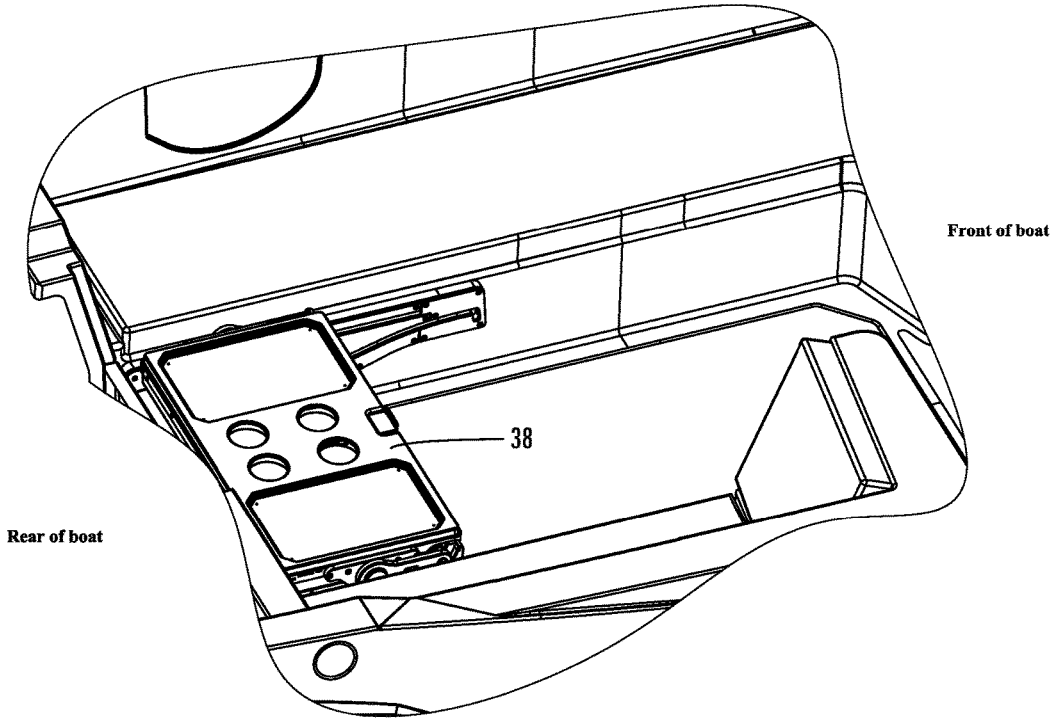

FIG. 5A and FIG. 5B show the seat assembly 10 in another configuration in which the slide brackets 28 are in the first slide position, the backrest brackets 32 are in the first bracket position, and the backrest 34 is in the second backrest position. The backrest portion 34 is rotated relative to the backrest bracket 32 such that the second side 38 of the backrest portion 34 is facing upward relative to a gravitational axis. The backrest bracket 32 is pivoted relative to the slide bracket 28 such that the first side 36 of the backrest portion 34 abuts or is adjacent to the seat bottom 26. The slide bracket 28 may be located towards a rear or aft portion of the watercraft 12 on the track bracket 18. In the configuration of FIG. 5A and FIG. 5B, the second side 38 of the backrest portion 34 may act as a table for passengers seated towards an aft portion of the watercraft 12.

Figure 6:
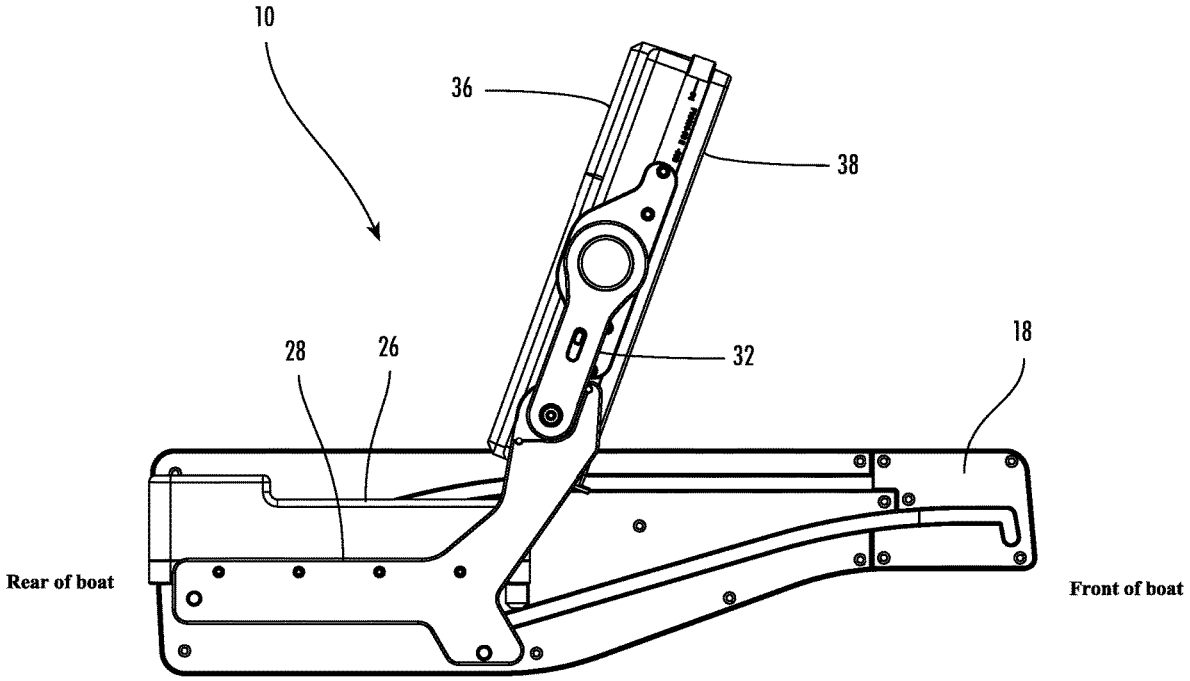
FIG. 6 shows a seat assembly in one configuration as an aft-facing seat according to one embodiment of the present disclosure.

FIG. 6 shows the seat assembly 10 in another configuration in which the slide brackets 28 are in the first slide position, the backrest brackets 32 are in the second bracket position, and the backrest 34 is in the first backrest position. The backrest bracket 32 is pivoted relative to the slide bracket 28 such that the backrest portion 32 is substantially upright or inclined relative to the seat bottom 26. The backrest portion 34 is rotated relative to the backrest bracket 32 such that the first side 36 of the backrest portion 34 is facing towards an aft or rear of the watercraft 12. The slide bracket 28 may be located towards a rear or aft portion of the watercraft 12 on the track bracket 18. In the configuration of FIG. 6, the first side 36 of the backrest portion 34 may act as a backrest for passengers seated facing towards an aft portion of the watercraft 12.

Figure 7A:
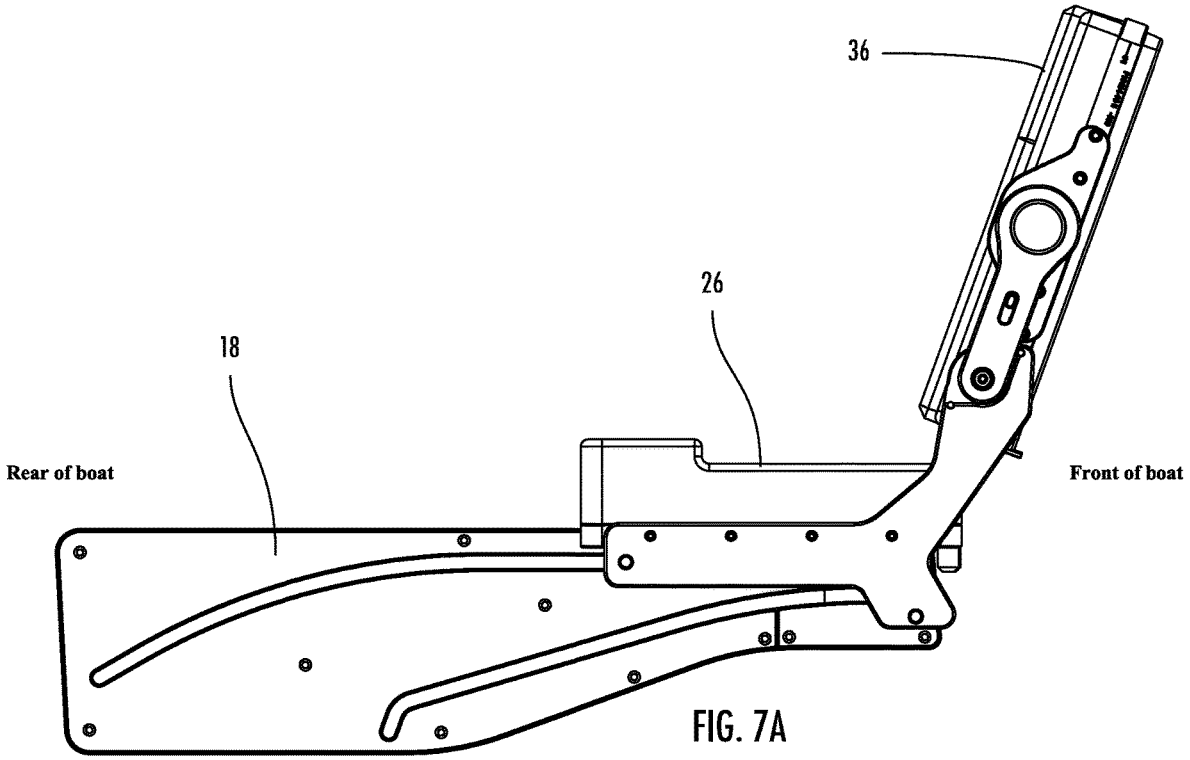
FIG. 7A and FIG. 7B show a seat assembly in one configuration as an aft-facing seat according to one embodiment of the present disclosure.
Figure 7B:
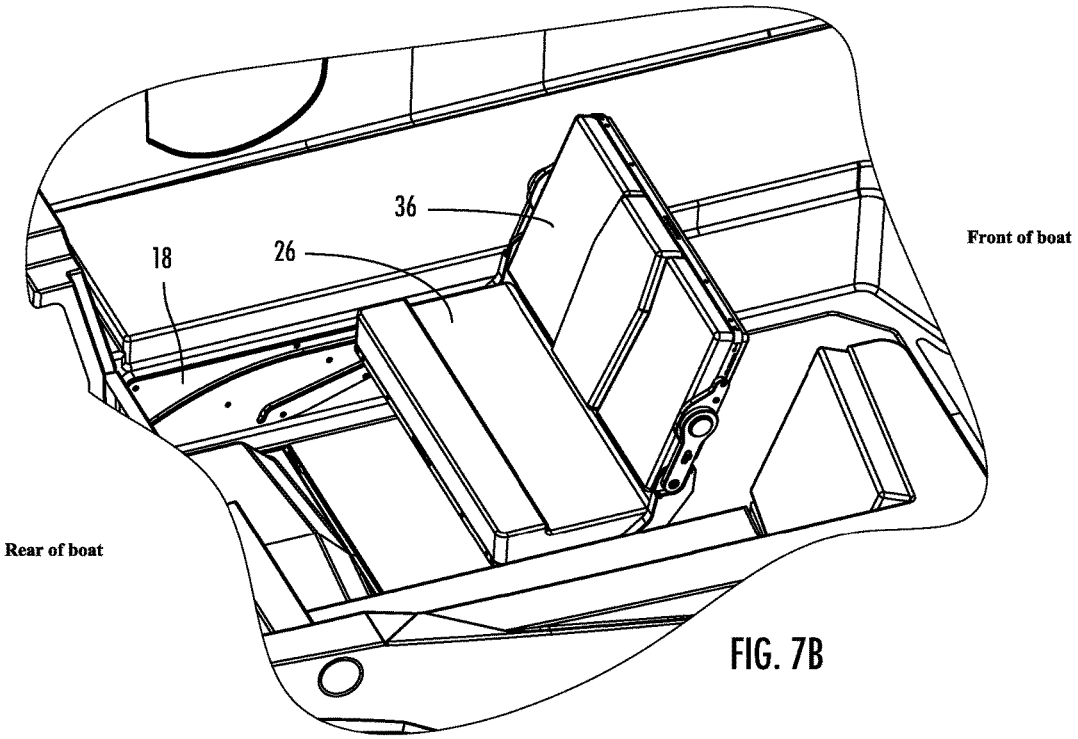

FIG. 7A and FIG. 7B shows the seat assembly 10 in another configuration in which the slide brackets 28 are in the second slide position, the backrest brackets 32 are in the second bracket position, and the backrest 34 is in the first backrest position. The backrest bracket 32 is pivoted relative to the slide bracket 28 such that backrest portion is substantially upright or inclined relative to the seat bottom 26. The backrest portion 34 is rotated relative to the backrest bracket 32 such that the first side 36 of the backrest portion 34 is facing towards an aft or rear of the watercraft 12. The slide bracket 28 may be located towards a front or fore portion of the watercraft 12 on the track bracket 18. In the configuration of FIG. 6, the first side 36 of the backrest portion 34 may act as a backrest for passengers seated facing towards an aft portion of the watercraft 12.

Figure 8A:
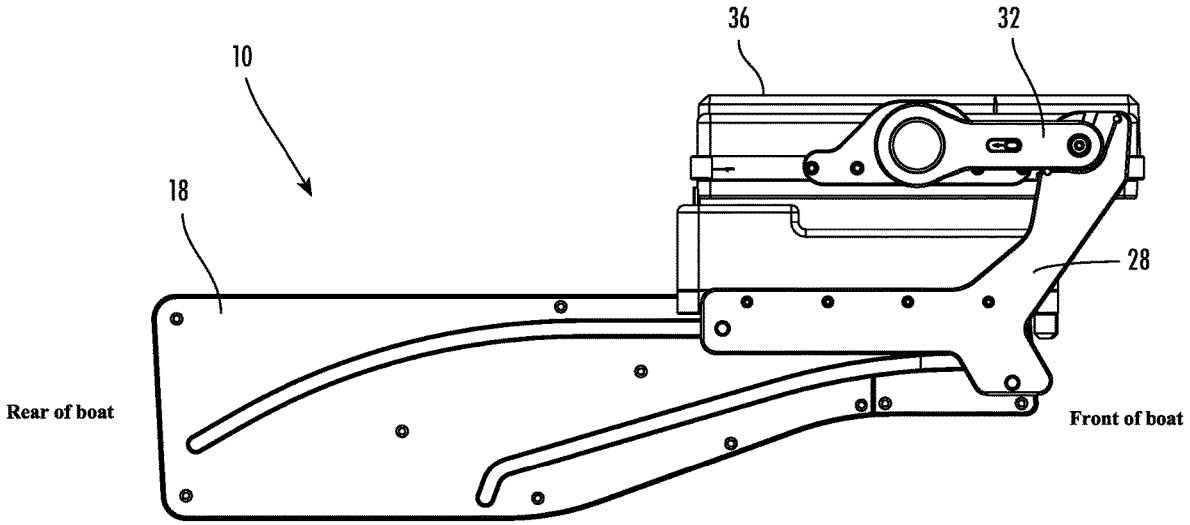
FIG. 8A and FIG. 8B show a seat assembly in one configuration according to one embodiment of the present disclosure.
Figure 8B:
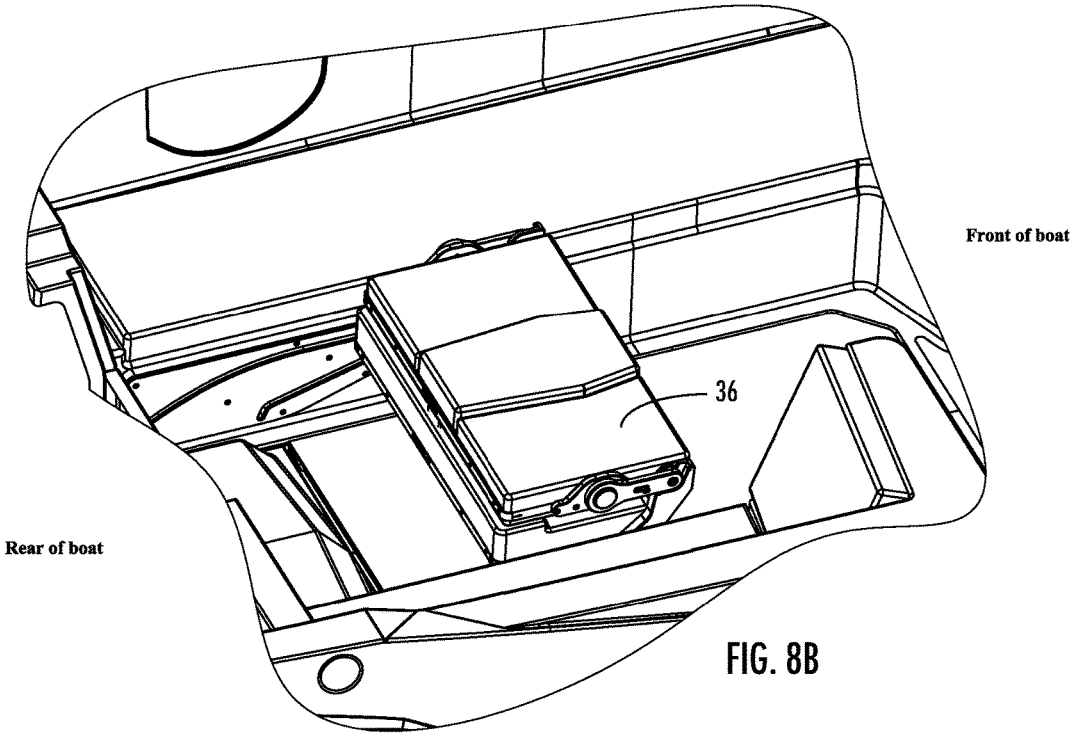

FIG. 8A and FIG. 8B show the seat assembly 10 in another configuration in which the slide brackets 28 are in the second slide position, the backrest brackets 32 are in the first bracket position, and the backrest 34 is in the third backrest position. The backrest portion 34 is rotated relative to the backrest bracket 32 such that the first side 36 of the backrest portion 34 is facing upward relative to a gravitational axis. The backrest bracket 32 is pivoted relative to the slide bracket 28 such that the second side 38 of the backrest portion 34 abuts or is adjacent to the seat bottom 26. The slide bracket 28 may be located towards a front or fore portion of the watercraft 12 on the track bracket 18. In the configuration of FIG. 8A and FIG. 8B, the first side 36 of the backrest portion 34 may act as a seat or bench for a passenger on the watercraft 12.

Figure 9A:
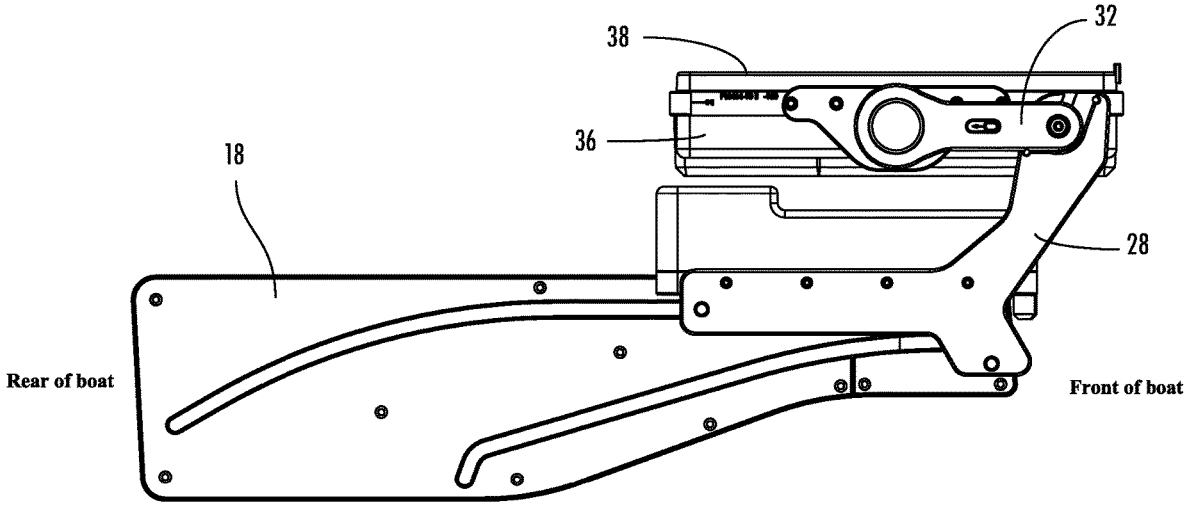
FIG. 9A and FIG. 9B show a seat assembly in one configuration as a table according to one embodiment of the present disclosure.
Figure 9B:
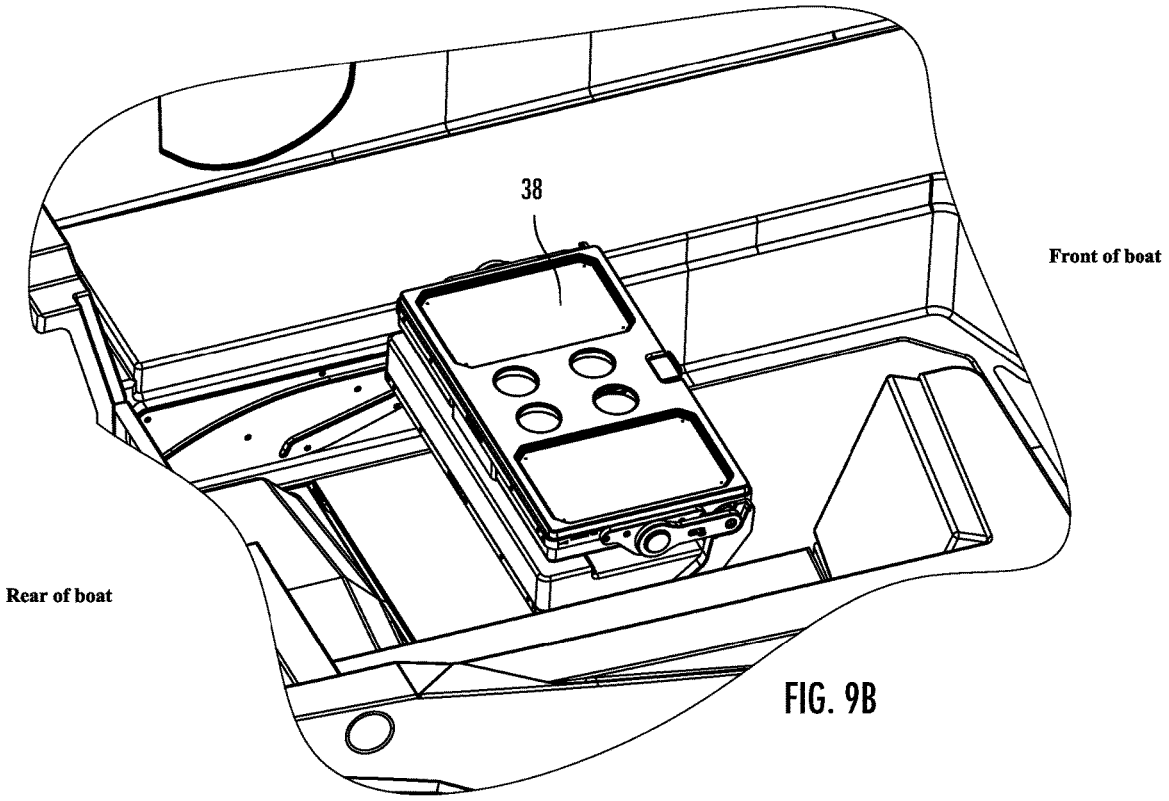

FIG. 9A and FIG. 9B show the seat assembly 10 in another configuration in which the slide brackets 28 are in the second slide position, the backrest brackets 32 are in the first bracket position, and the backrest 34 is in the second backrest position. The backrest portion 34 is rotated relative to the backrest bracket 32 such that the second side 38 of the backrest portion 34 is facing upward relative to a gravitational axis. The backrest bracket 32 is pivoted relative to the slide bracket 28 such that the first side 36 of the backrest portion 34 rests against or is adjacent to the seat bottom 26. The slide bracket 28 may be located towards a front or fore portion of the watercraft 12 on the track bracket 18. In the configuration of FIG. 9A and FIG. 9B, the second side 38 of the backrest portion 34 may act as a table for passengers seated in the watercraft 12.

Figure 10A:
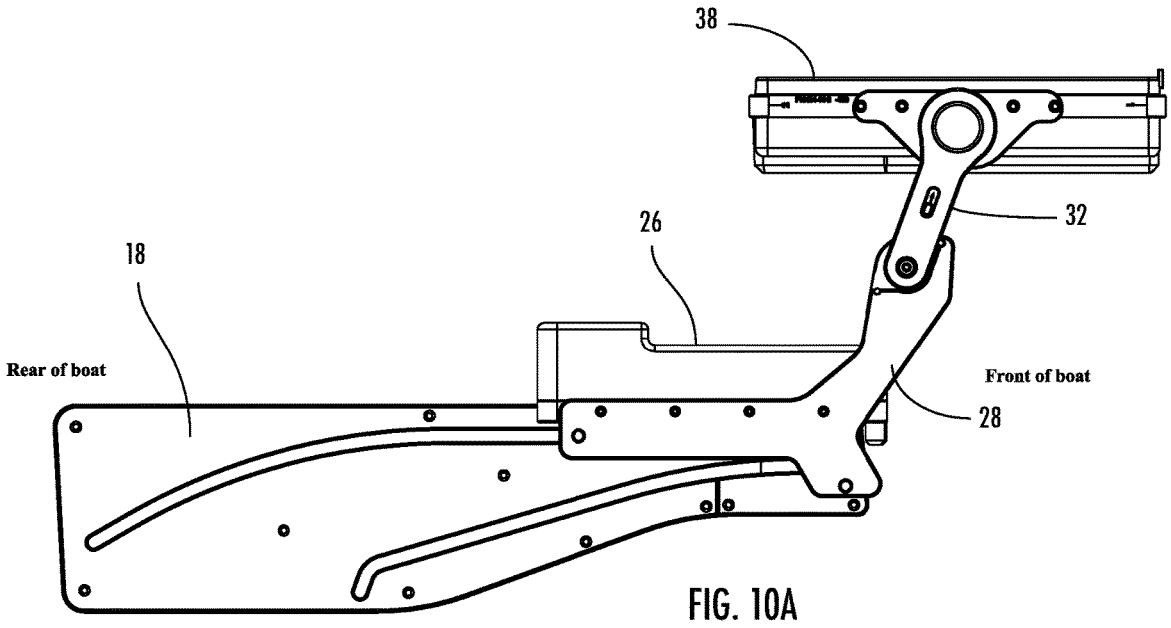
FIG. 10A and FIG. 10B show a seat assembly in one configuration as a table according to one embodiment of the present disclosure.
Figure 10B:
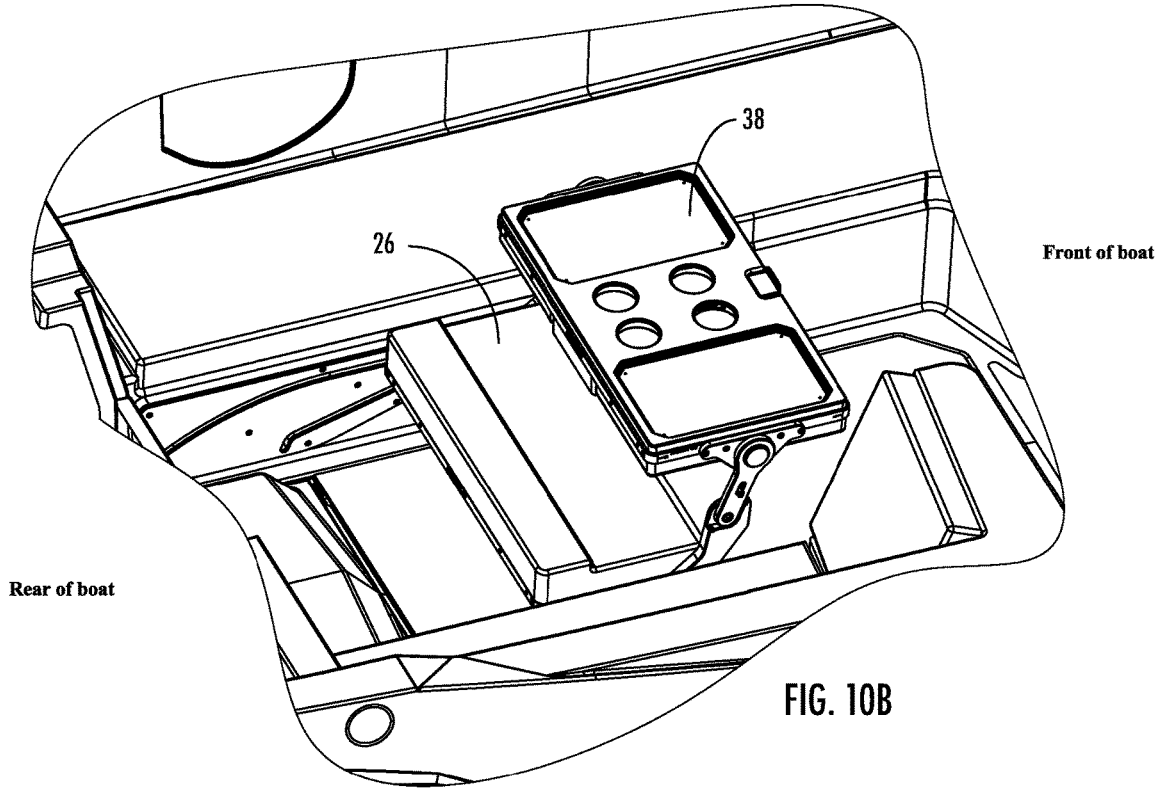

FIG. 10A and FIG. 10B show the seat assembly 10 in another configuration in which the slide brackets 28 are in the second slide position, the backrest brackets 32 are in the second bracket position, and the backrest 34 is in the second backrest position. The backrest portion 34 is rotated relative to the backrest bracket 32 such that the second side of the backrest portion 34 is facing upward relative to a gravitational axis. The backrest bracket is pivoted relative to the slide bracket 28 such that the backrest portion 34 is elevated above the seat bottom 26. The slide bracket may be located towards a front or fore portion of the watercraft 12 on the track bracket 18. In the configuration of FIG. 10A and FIG. 10B, the backrest portion 34 may act as a table that is elevated above seating of the watercraft 12 for passengers on the watercraft 12.

It is understood that the seat assembly 10 may be arranged in various other configurations of the backrest portion 34 relative to the seat bottom 26 such that the seat assembly 10 may be configured for seating and/or for providing a table surface on the watercraft 12. The seat assembly 10 advantageously allows for various configurations of seating while also providing for table space on the watercraft 12 without occupying significant space on the watercraft 12.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A seat assembly comprising:

one or more track brackets each having a track face, a fore edge, an aft edge opposite and spaced apart from the fore edge, a first edge extending between the fore edge and the aft edge, and a second edge opposite and spaced apart from the first edge, wherein the track face of each of the one or more track brackets defines one or more tracks, wherein the one or more tracks each have a first end and a second end longitudinally spaced apart from the first end, wherein the first end of each of the one or more tracks is closer than the second end of the respective track to the fore edge and the second edge;

one or more slide brackets including one or more pins extending therefrom, wherein each of the one or more pins slidably engages one of the one or more tracks, wherein the one or more slide brackets are slidable between a first slide position and a second slide position, wherein at least one of the one or more pins is located adjacent the first end of the track to which it is engaged in the first slide position and the one of the one or more pins or another of the one or more pins is located adjacent the second end of the track to which it is engaged in the second slide position; and a seat bottom coupled to the one or more slide brackets.

2. The seat assembly of claim 1, wherein the one or more track brackets include two track brackets and the one or more slide brackets include two slide brackets.

3. The seat assembly of claim 1, wherein the one or more tracks include two tracks defined by each of the one or more track brackets, wherein the one or more pins include two pins extending from each of the one or more slide brackets, wherein each of the two pins extending from each of the one or more slide brackets engages a separate one of the two tracks.

4. The seat assembly of claim 1, further comprising:

one or more backrest brackets each coupled to a separate one of the one or more slide brackets; and a backrest portion coupled to the one or more backrest brackets.

5. The seat assembly of claim 4, wherein the one or more backrest brackets are each pivotally coupled to the separate one of the one or more slide brackets, wherein the one or more backrest brackets are pivotable relative to the one or more slide brackets between a first bracket position and a second bracket position, wherein the backrest portion is closer to the seat bottom in the first bracket position than it is in the second bracket position.

6. The seat assembly of claim 5, further comprising a backrest bracket release mechanism for releasably retaining the backrest bracket in the first bracket position or the second bracket position.

7. The seat assembly of claim 4, wherein the backrest portion is pivotably coupled to the one or more backrest brackets, wherein the backrest portion has a first side and a second side opposite and spaced apart from the first side, wherein the first side includes a cushion, wherein the second side includes a tabletop.

8. The seat assembly of claim 7, wherein the tabletop of the second side of the backrest portion defines one or more recesses.

9. The seat assembly of claim 7, wherein the seat bottom has a seat surface, wherein the backrest portion is pivotable relative to the one or more backrest brackets between a first backrest position and a second backrest position, wherein the first side of the backrest portion forms a backrest for the seat bottom in the first backrest position and the second side of the backrest portion is substantially parallel with the seat surface in the second backrest position.

10. The seat assembly of claim 9, further comprising a backrest release mechanism for releasably retaining the backrest portion in the first backrest position or the second backrest position.

11. A seat assembly comprising:

one or more track brackets each having a track face, wherein the track face of each of the one or more track brackets defines one or more tracks;

one or more slide brackets including one or more pins extending therefrom, wherein each of the one or more pins slidably engages one of the one or more tracks;

one or more backrest brackets each pivotally coupled to a separate one of the one or more slide brackets;

a seat bottom coupled to the one or more slide brackets; and a backrest portion coupled to the one or more backrest brackets, wherein the one or more backrest brackets are pivotable relative to the one or more slide brackets between a first bracket position and a second bracket position, wherein the backrest portion is closer to the seat bottom in the first bracket position than it is in the second bracket position.

12. The seat assembly of claim 11, further comprising a backrest bracket release mechanism for releasably retaining the backrest bracket in the first bracket position or the second bracket position.

13. The seat assembly of claim 11, wherein the backrest portion is pivotably coupled to the one or more backrest brackets, wherein the backrest portion has a first side and a second side opposite and spaced apart from the first side, wherein the first side includes a cushion, wherein the second side includes a tabletop.

14. The seat assembly of claim 13, wherein the tabletop of the second side of the backrest portion defines one or more recesses.

15. The seat assembly of claim 13, wherein the seat bottom has a seat surface, wherein the backrest portion is pivotable relative to the one or more backrest brackets between a first backrest position and a second backrest position, wherein the first side of the backrest portion forms a backrest for the seat bottom in the first backrest position and the second side of the backrest portion is substantially parallel with the seat surface in the second backrest position.

16. The seat assembly of claim 15, further comprising a backrest release mechanism for releasably retaining the backrest portion in the first backrest position or the second backrest position.

17. A seat assembly comprising:

one or more track brackets each having a track face, wherein the track face of each of the one or more track brackets defines one or more tracks;

one or more slide brackets including one or more pins extending therefrom, wherein each of the one or more pins slidably engages one of the one or more tracks;

one or more backrest brackets each coupled to a separate one of the one or more slide brackets;

a seat bottom coupled to the one or more slide brackets, wherein the seat bottom has a seat surface; and a backrest portion pivotably coupled to the one or more backrest brackets, wherein the backrest portion has a first side and a second side opposite and spaced apart from the first side, wherein the first side includes a cushion, wherein the second side includes a tabletop, wherein the backrest portion is pivotable relative to the one or more backrest brackets between a first backrest position and a second backrest position, wherein the first side of the backrest portion forms a backrest for the seat bottom in the first backrest position and the second side of the backrest portion is substantially parallel with the seat surface in the second backrest position.

18. The seat assembly of claim 17, wherein the tabletop of the second side of the backrest portion defines one or more recesses.

19. The seat assembly of claim 17, further comprising a backrest release mechanism for releasably retaining the backrest portion in the first backrest position or the second backrest position.

* * * * *